United States Patent [19]

Jameson et al.

[11] Patent Number: 4,529,976

[45] Date of Patent: Jul. 16, 1985

[54] SMOKE DETECTOR WITH MASKING SHIELD

[75] Inventors: Frederick M. Jameson, 220 Wintergreen La., Brunswick, Md. 21716; Donald C. Roylance, Potomac, Md.

[73] Assignee: Frederick M. Jameson, Sherman Oaks, Calif.

[21] Appl. No.: 437,870

[22] Filed: Oct. 29, 1982

[51] Int. Cl.[3] ..... G08B 17/10

[52] U.S. Cl. ..... 340/628; 40/10 R; 340/693; 428/919

[58] Field of Search ..... 340/628, 629, 630, 693; 250/381, 574; 179/178; 40/10 R, 10 D, 152, 307, 486, 489, 555; 63/14 R, 20; 98/40 B, 40 D, 122; 362/806; 428/64, 79, 904.4, 919; 52/311; 24/113 MP; 411/373

[56] References Cited

U.S. PATENT DOCUMENTS

| | | | |
|---|---|---|---|
| 2,595,672 | 5/1952 | Greenwood | 179/178 |
| 3,409,885 | 11/1968 | Hall | 250/574 X |
| 3,460,124 | 8/1969 | Smith et al. | 340/630 |
| 3,731,093 | 5/1973 | Scheidweiler et al. | 340/629 X |
| 3,908,957 | 9/1975 | Schütt | 340/629 X |
| 3,916,209 | 10/1975 | Steele et al. | 340/630 X |
| 4,092,641 | 5/1978 | Bellinghausen et al. | 340/629 X |
| 4,223,305 | 9/1980 | Arima | 250/381 X |
| 4,238,788 | 12/1980 | Rosauer et al. | 340/629 X |
| 4,249,082 | 2/1981 | Kakigi et al. | 250/574 |
| 4,282,520 | 8/1981 | Shipp et al. | 250/381 X |

*Primary Examiner*—James L. Rowland
*Assistant Examiner*—Daniel Myer
*Attorney, Agent, or Firm*—Roylance, Abrams, Berdo & Goodman

[57] ABSTRACT

A smoke detector is provided with a masking shield which obscures the smoke detector housing from normal view. Particularly in the case of installation of smoke detectors in children's bedrooms, the invention prevents the detector from appearing as a representation of the threat of fire.

16 Claims, 15 Drawing Figures

SMOKE DETECTOR WITH MASKING SHIELD

This invention relates to smoke detectors of the type intended for mounting on, e.g., the ceiling or wall of a room to detect smoke and provide an alarm in response to occurrence of smoke.

BACKGROUND OF THE INVENTION

Smoke detectors of the type referred to have achieved significant acceptance and are recognized as one of the most important tools available for reducing deaths and injuries from fires in homes. Many states and counties in the United States now require installation of such smoke detectors in homes, and the detectors have been installed in large numbers, particularly in basements, hallways near kitchens, and stair areas. However, installation of smoke detectors in children's bedrooms has not met with great favor. One reason for this is that, in the eyes of younger children particularly, the smoke detector represents the threat of fire, therefore is frightening. To a lesser degree, adults sometimes refrain from installing smoke detectors because they consider them unattractive from a decorating standpoint. There has accordingly been a continuing need to provide smoke detectors which will be attractive to children, rather than symbolizing the threat of fire, and which will be more acceptable for installation in household areas where devices of purely mechanical appearance may be considered inappropriate.

OBJECTS OF THE INVENTION

A general object of the invention is to provide, in combination with a smoke detector housing, a shield which masks the smoke detector from normal view.

Another object is to provide such a device in which the shield is of such nature as to be capable of presenting an ornamental image, design or set of indicia to the viewer.

A further object is to provide such a device in which the shield is detachable from the smoke detector housing and the shield or a different shield can be reattached.

Yet another object is to provide such a device in which a force applied to the shield, or to a particular portion of an image carried by the shield, will be effective to operate a test switch embodied in the smoke alarm.

SUMMARY OF THE INVENTION

Devices according to the invention comprise a smoke detector housing adapted to be mounted on a supporting surface and having smoke flow openings exposed to the space adjacent the supporting surface when the housing is so mounted; a shield having lateral dimensions at least as great as those of the housing; and a support to which the shield is secured, portions of the support and the housing being constructed and arranged to coact as releasable fastener means for securing the support and shield to the housing, the support being dimensioned and arranged to position the shield a substantial distance from the smoke flow openings of the housing when the releasable fastener means is engaged to secure the support and shield to the housing, the dimensions and shape of the shield being such that, when so secured, the shield obscures the housing from normal view. In advantageous embodiments, the support comprises a plurality of resiliently deformable mounting prongs each of which is engaged through an opening in the housing, and the openings are larger than the transverse dimensions of the respective prongs and serve as smoke flow openings. In other embodiments, the shield is releasably attached to the support, so that any one of a number of shields, each with a different image, can be used selectively. In other embodiments, applying a force to the shield, or to a particular point on an image carried by the shield, will move the combination of the shield and support to actuate the push button of a switch for testing the smoke alarm.

IDENTIFICATION OF THE DRAWINGS

In the drawings, which form part of the original disclosure of this application, FIG. 1 is a side elevational view of a smoke detector housing and shield according to one embodiment of the invention;

DETAILED DESCRIPTION OF THE INVENTION

The Embodiment of FIGS. 1-6

Figure 6:
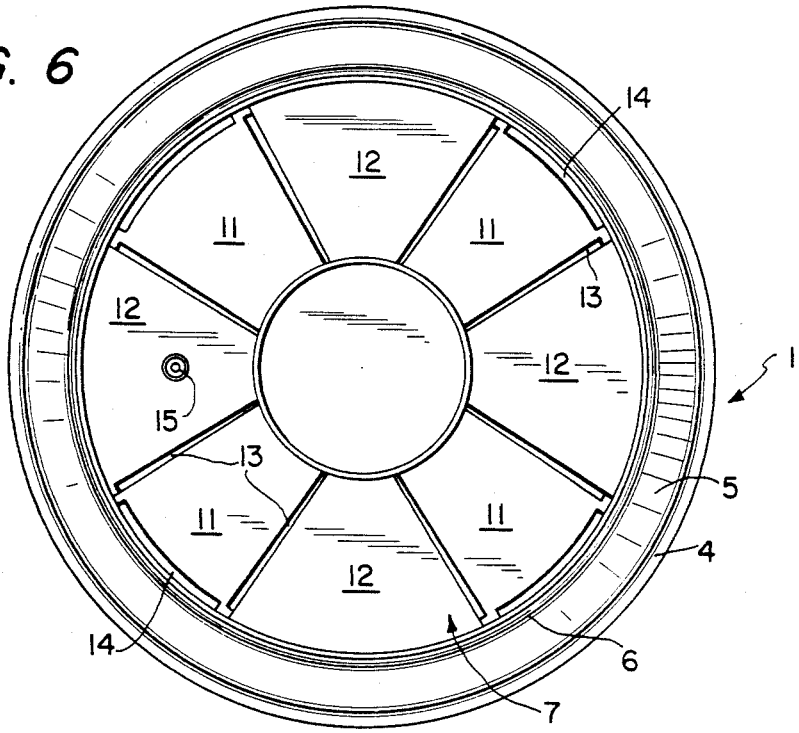
FIG. 6 is a view, partly in cross section and partly in elevation, taken generally on line 6—6, FIG. 1 with the shield and support removed.

In this embodiment, the device comprises a smoke detector housing, indicated generally at 1, a support, indicated generally at 2, and a shield, indicated generally at 3. Housing 1 is generally conventional, constructed in accordance with U.S. Pat. No. Des. 247,665, issued Apr. 4, 1978, to Larry D. Larsen. The housing comprises an outer shell which is generally in the form of a shallow cup and includes an upper side wall portion 4, an intermediate side wall portion 5, a lower side wall portion 6 and a segmented bottom wall 7. Side wall portions 4-6 are generally frustoconical, portions 4 and 6 tapering downwardly and inwardly at a smaller angle, portion 5 tapering in the same direction at a much larger angle so that portion 5 faces mainly downwardly. The housing is completed by a base member 8, on which the electrical components (not shown) of the detector are mounted, the outer shell being connected to the base member by hinges 9 and a latch 10, and the entire structure being mounted on, e.g., the ceiling of a room. As seen in FIG. 6, alternate trapezoidal segments 11 of bottom wall 7 slant outwardly and upwardly, while the remaining segments 12 lie in a common horizontal plane, so that the segments define smoke flow openings at 13 and 14. Since the dependent side wall of base member 8 is spaced inwardly from the upper end of side wall portion 4, the base member and the upper portion of the side wall of the shell coact to define a continuous, annular smoke flow opening. A push button 15 for a conventional test switch (not shown) projects downwardly through an opening in one of the segments 12 of bottom wall 7.

Figure 1:
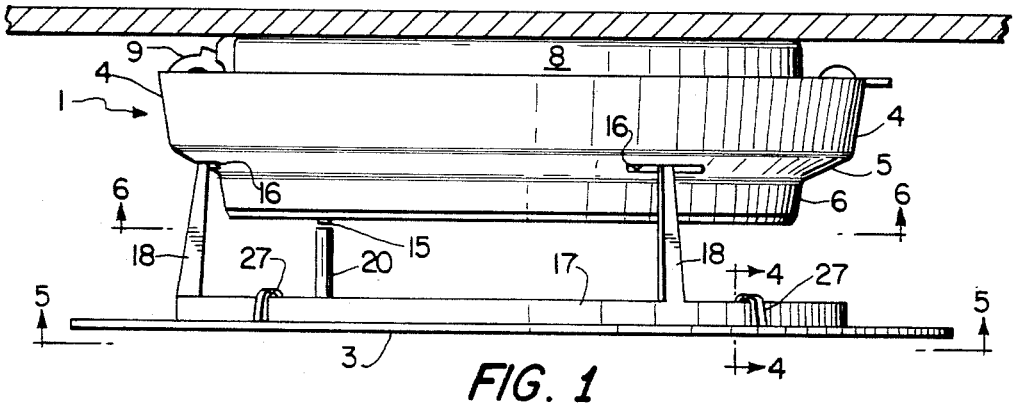
Figure 2:
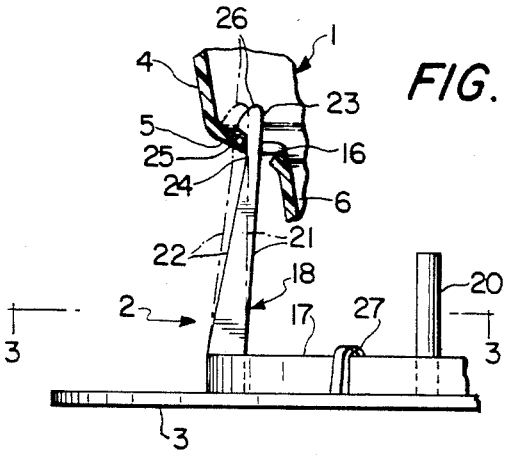
FIG. 2 is a fragmentary view, partly in side elevation and with a part of the housing in cross section, showing one mounting prong of the support of the device of FIG. 1 engaged with the housing.
Figure 3:
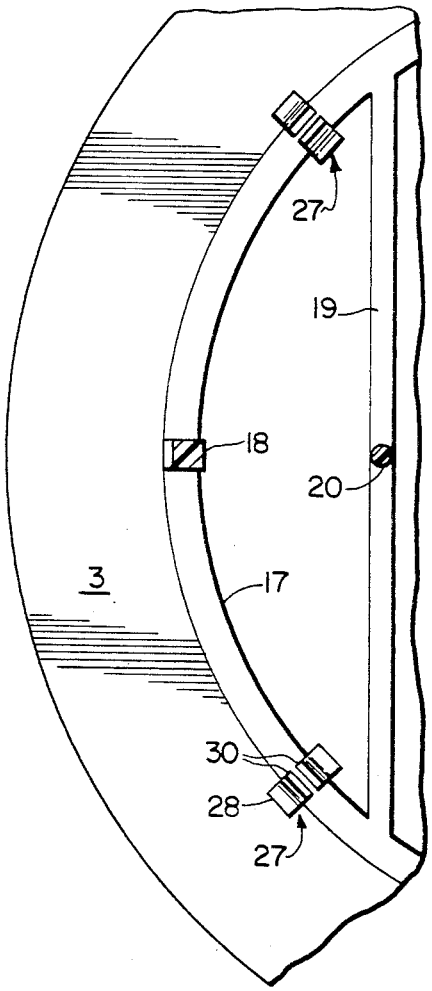
FIG. 3 is a fragmentary sectional view taken generally on line 3—3, FIG. 2, with parts shown in elevation.

Unlike the prior-art housing shown in U.S. Pat. No. Des. 247,665, housing 1 is modified by providing in intermediate side wall portion 5 of the outer shell three arcuate openings 16 which are equally spaced circumferentially and which open generally downwardly, as shown in FIGS. 1, 2 and 6.

Support 2 is an integral piece formed, e.g., from thermoplastic polymeric material by injection molding, and includes a base ring 17, in the form of an axially short right circular cylinder of significant radial thickness, and three prongs 18 which project upwardly from the base ring and are spaced equally therearound. The integral piece also includes a chordally extending portion 19, FIG. 3, and an upstanding actuator pin 20. The polymeric material from which support 2 is molded is one which is rigid, in the sense of the definition of that term in Whittington's Dictionary of Plastics, 2d Edition, but has adequate resilient deformability to allow significant resilient lateral deformation of a piece the cross-sectional dimensions of which are small in comparison to the length. Any of a variety of nylons, polyolefins, polyesters, polyvinyl chlorides and polymer alloys can be employed.

The lower edges of ring 17 and portion 19 lie in a common plane. Prongs 18 are identical, each being of rectangular transverse cross section and including an inner edge 21, an outer edge 22 and a tip 23. Inner edges 21 extend in the plane of the inner cylindrical surface of ring 17, when the prongs are relaxed and undistorted, while outer edges 22 slant inwardly toward the respective tips 23. Each tip 23 has a straight edge portion 24, FIG. 2, which joins the corresponding outer edge 22 and is slightly longer than the thickness of the shell, an upwardly and outwardly slanting shoulder 25, and a rounded terminal edge 26 which serves as a camming edge.

Figure 4:
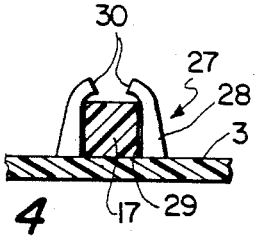
FIG. 4 is a fragmentary sectional view taken generally on line 4—4, FIG. 1.

In this embodiment, shield 3 is a flat piece formed of rigid thermoplastic polymeric material and having, formed integrally therewith, three clips 27 for detachably securing the shield to the support. As seen in FIG. 4, each clip 27 comprises two short tapered prongs 28, the inner edges 29 of the prongs being parallel and spaced apart by a distance only slightly greater than the radial thickness of ring 17, the tips of prongs 28 being curved toward each other and having upwardly exposed divergent camming edges 30 which, when prongs 28 are relaxed and undistorted, are spaced apart by a distance substantially less than the radial thickness of ring 17. Shield 3 is attached to support 2 by placing ring 17 on the divergent edges 30 of clips 27, then forcing the support toward the shield to cause ring 17 to coact with edges 30, camming prongs 28 apart until the ring snaps into the position seen in FIG. 4. Reversing that procedure allows the shield to be detached from the support, so that a different shield can be attached to the support.

With the shield attached to the support, the combination of the shield and support is attached to the smoke detector housing by first aligning prongs 18 with openings 16, then moving the shield and support toward the housing until, camming edges 26 having engaged the outer edges of the respective openings 16, movement of the support toward the housing causes prongs 18 to be resiliently distorted, each prong being deflected inwardly, until the shoulder 25 of each prong passes beyond the wall of the outer shell. Prongs 18 now spring outwardly, toward their original relaxed and undistorted positions, causing shoulders 25 to engage over the respective outer edges of openings 16 so that the combination of support 2 and shield 3 is suspended from the outer shell of the housing. When the support and shield are being thus installed, care is taken to select the rotational position of the support, relative to the housing, so that actuator pin 20 is aligned with push button 15. When the prongs are in the positions shown in FIG. 2, there is a slight space between the upper end of pin 20 and the face of push button 15. The length of straight edges 24 of prongs 18 is such as to allow the combination of support 2 and shield 3 to be pushed upwardly, toward the smoke detector housing, through a distance greater than the space between pin 20 and push button 15, so that the test switch can be actuated simply by pushing upwardly on the shield.

Figure 5:
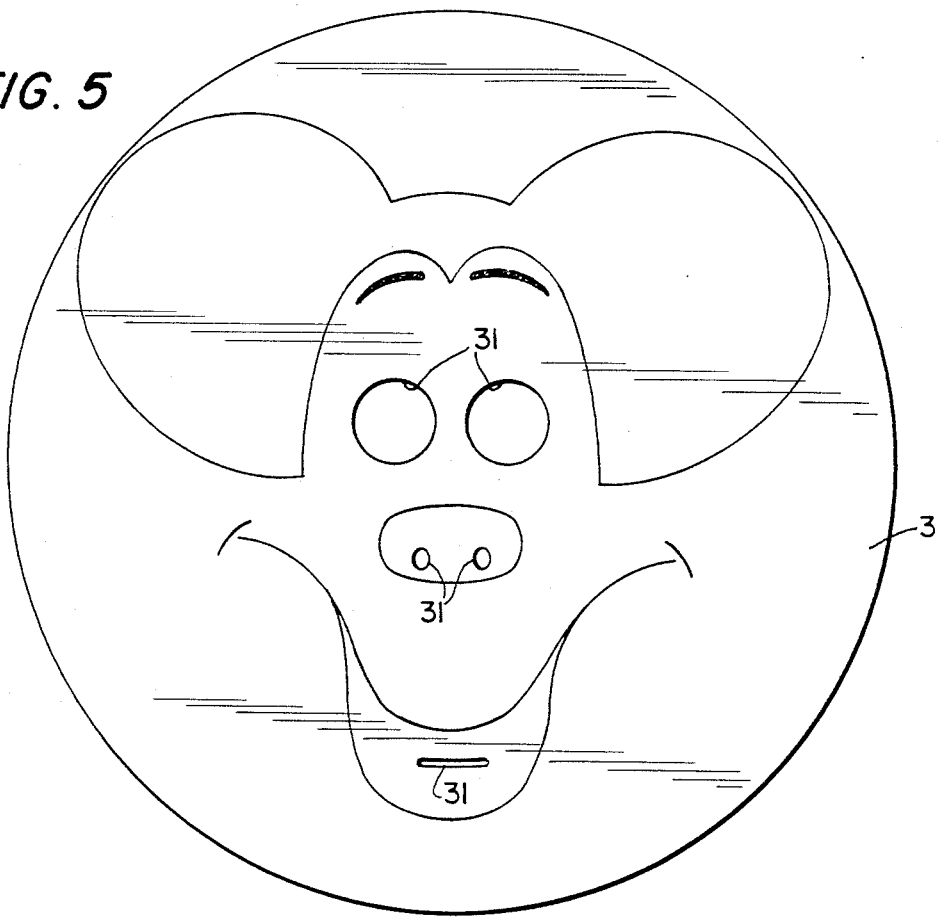
FIG. 5 is an elevational view taken generally as indicated by line 5—5, FIG. 1.
Figure 8:
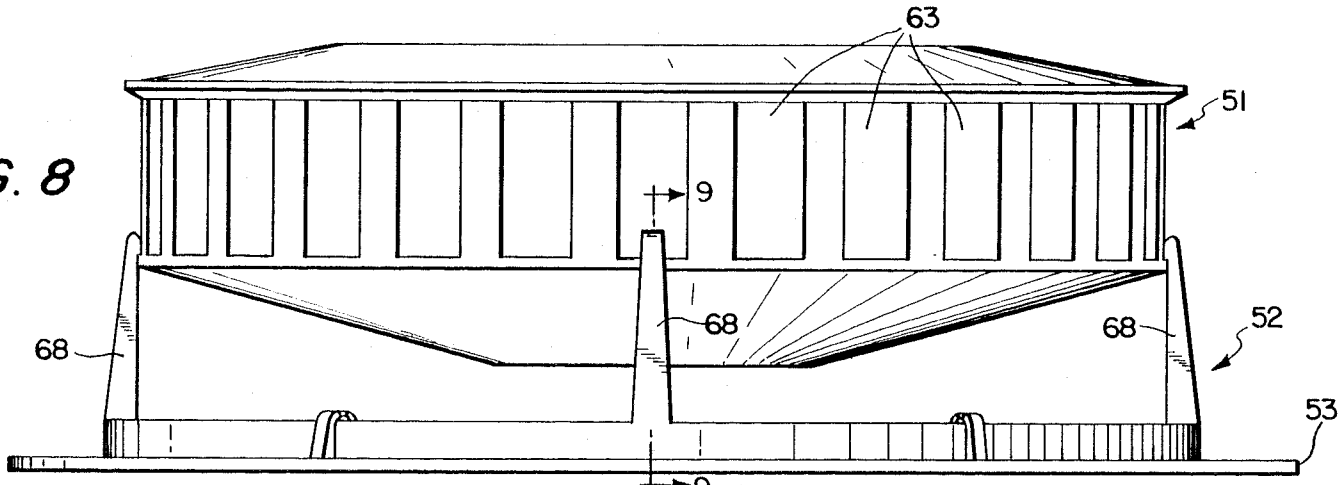
FIG. 8 is a side elevational view of a smoke detector housing and shield according to another embodiment.

As seen in FIG. 5, the lower face of shield 3 carries a representation of a decorative figure, a representation of the cartoon character Mickey Mouse being chosen for illustrative purposes. In this embodiment, the representation of the eyes, nostrils and mouth of the figure include openings 31 which constitute smoke flow openings. In addition, it is to be noted that the effective length of prongs 18 is such that, when the support and shield have been attached to the housing as seen in FIG. 1, there is a substantial air flow space between shield 3 and bottom wall 7 of the housing.

THE MODIFICATION OF FIG. 7

Figure 7:
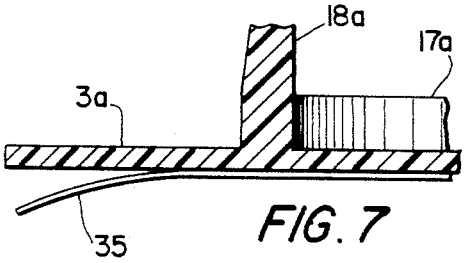
FIG. 7 is a fragmentary sectional view illustrating a modified form of the shield and support for the device of FIGS. 1-6.

Rather than having the shield detachable from the support, so that the decorative design can be changed easily, the shield can be permanently attached to the support and the design can be carried by a detachable sheet, as seen in FIG. 7. Here, prongs 18*a*, base ring 17*a* and shield member 3*a* are all parts of an integral piece of polymeric material. The decorative design is carried by a paper sheet 35 secured to the lower face of the shield by any conventional permanently tacky adhesive, so that the sheet bearing the design can be removed and replaced by another sheet bearing a different design.

THE EMBODIMENT OF FIGS. 8 AND 9

Figure 9:
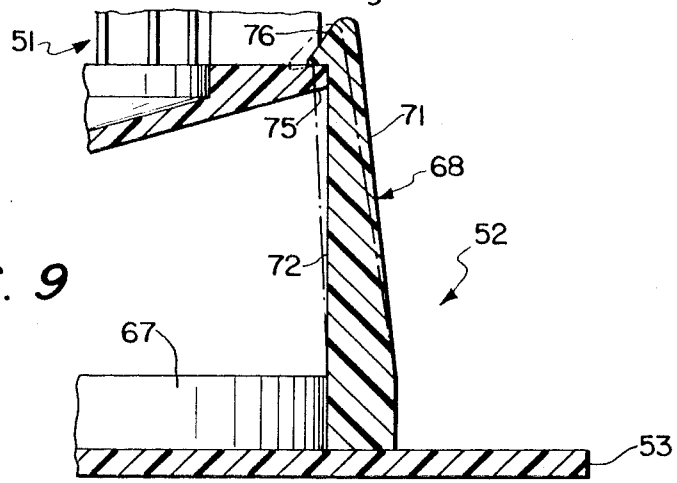
FIG. 9 is a sectional view taken generally on line 9—9, FIG. 8.

In this embodiment, the invention is applied to a conventional smoke detector housing, indicated generally at 51, and again includes support 52 and shield 53. Housing 51 has neither a top nor bottom smoke flow opening but, rather, is laterally louvered to provide a circular series of smoke flow openings 63 each in the form of a rectangle elongated from top to bottom, the openings being equally spaced circumferentially of the shell of the housing. Support 52 and shield 53 remain as described with reference to FIGS. 1–6, save that each prong 68 is constructed to coact with the lower wall of one of the openings 63. Thus, integral with base ring 67, each prong 68 has an inner edge 72, an outer edge 71, a shoulder 75 at the upper end of edge 72, and an upwardly and outwardly slanting camming edge 76 which joins edge 71 at the tip of the prong. Thus, the combination of the support and shield is installed simply by aligning prongs 68 each with a different one of the openings 63 and forcing the shield and support toward the housing, with edges 76 of the prongs coacting to bend the prongs outwardly, from the normal relaxed and undistorted position indicated in dotted lines in FIG. 9, until the tips of the prongs pass beyond the lower walls of openings 63 and the prongs spring resiliently back to the position seen in solid lines in FIG. 9, shoulders 75 then engaging over the lower wall of the opening, as shown, to suspend the combination of the support and shield from the housing.

THE EMBODIMENT OF FIGS. 10–15

Figure 10:
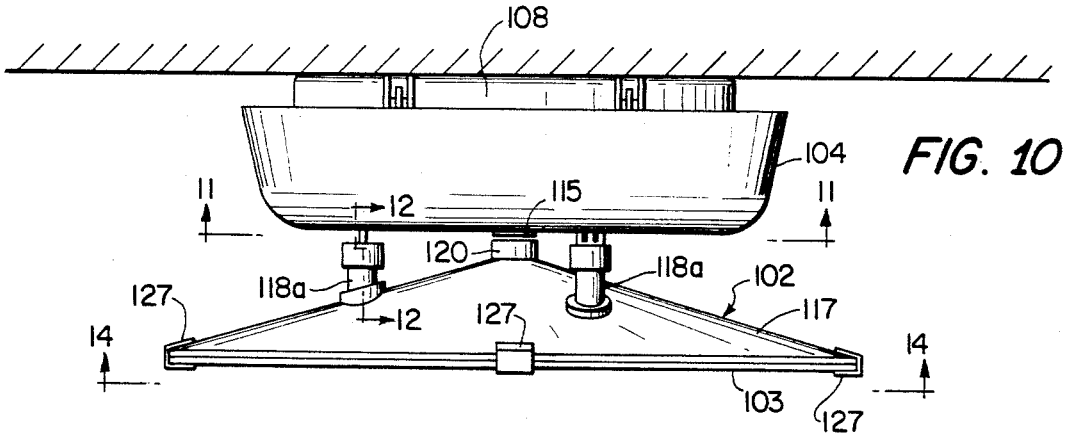
FIG. 10 is a side elevational view of a smoke detector housing and shield according to another embodiment.
Figure 11:
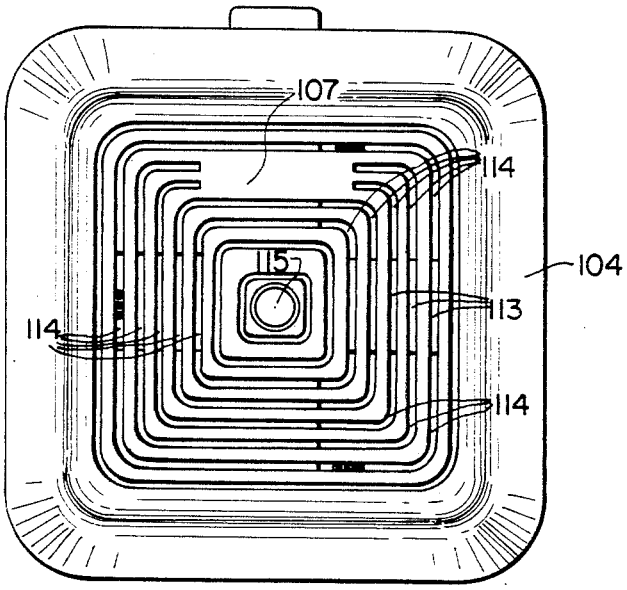
FIG. 11 is a view, partly in cross section and partly in elevation, taken generally on line 11—11, FIG. 10.
Figure 12:
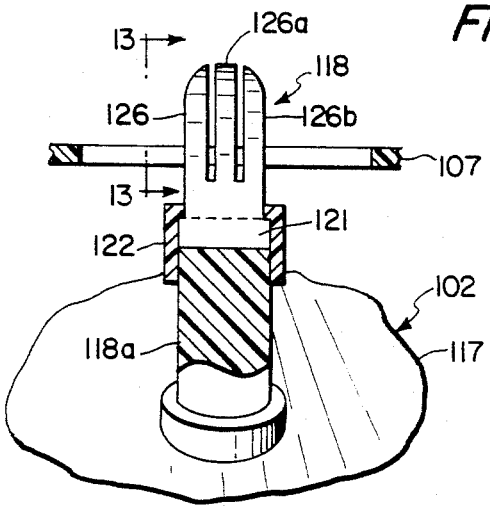
FIG. 12 is a fragmentary sectional view taken generally on line 12—12, FIG. 10.
Figure 13:
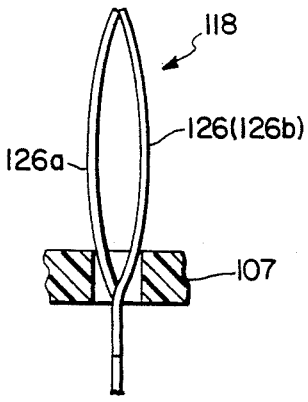
FIG. 13 is a fragmentary sectional view taken generally on line 13—13, FIG. 12.

FIGS. 10–15 show the invention as applied to a smoke detector housing of the type shown in U.S. Pat. No. Des. 242,133, issued Nov. 2, 1976, to George H. Fitzsimonds. As shown in FIGS. 10 and 11, such housings include an outer shell which is square in plan shape, and a base 108 of similar plan shape but smaller transverse dimensions, so that the shell and base coact to define an opening directed toward the surface on which the housing is mounted. The side walls 104 of the shell slant downwardly and inwardly to join a bottom wall 107 provided with a concentric series of grooves 113 which extend parallel to the side edges of the square bottom wall, portions 114 of each groove being cut completely through the wall to provide a plurality of downwardly directed smoke flow openings. The push button 115 for the test switch (not shown) of the smoke detector projects downwardly through an opening at the center of bottom wall 107.

This embodiment comprises a support 102 and, detachably secured to the support, a masking shield 103. The support includes an integral body of rigid polymeric material, the body comprising a conically dished downwardly opening main wall 117, three stems 118*a* and a central actuating pin 120. Main wall 117 is of uniform thickness, defined by mutually parallel conical surfaces which taper upwardly and inwardly from the periphery of the wall. Stems 118*a* are mutually identical, have a right circular cylindrical outer surface, are spaced equally in a circular series centered on pin 120, and project from the upper surface of wall 117 and at right angles to the plane of the periphery of that wall. Pin 120 has a lower end face lying in the plane of the periphery of wall 117, the pin projecting beyond the upper limit of the conical main wall to terminate in a flat, transverse upper end face 120*a*.

Each stem 118*a* carries a formed sheet metal prong 118. Mutually identical, the prongs each have a rectangular base 121 inserted in a transverse slot in the end of the stem, a ferrule 122 being fitted over base 121 and telescoped on the stem and cemented thereto to retain the prong. The prong is in the form of a flat piece of spring metal provided with two longitudinal slits to form projecting fingers 126, 126*a* and 126*b*. As seen by comparison of FIGS. 12 and 13, fingers 126 and 126*b* are bowed in one direction, finger 126*a* in the opposite direction, so that the formed prong can be forced through any of the openings 114 in wall 107, the bowed portions of the fingers being distorted while passing through the opening and springing back to normal, relaxed condition after passing through the opening. Thus, with all three prongs 118 having been inserted, the bowed fingers resist downward movement of the prong relative to wall 107, so that support 102 is suspended from the bottom wall of the shell of the housing, as will be clear from FIGS. 10, 13 and 14. As will be clear from comparison of FIGS. 10 and 11, the disposition of stems 118 is such that two of the prongs 118 are parallel and disposed for insertion through a single opening 114, while the third prong is disposed for insertion through a like opening 114 in the opposite portion of wall 107. And, with the prongs thus inserted through openings 114, actuating pin 120 is aligned vertically below push button 115.

Figure 14:
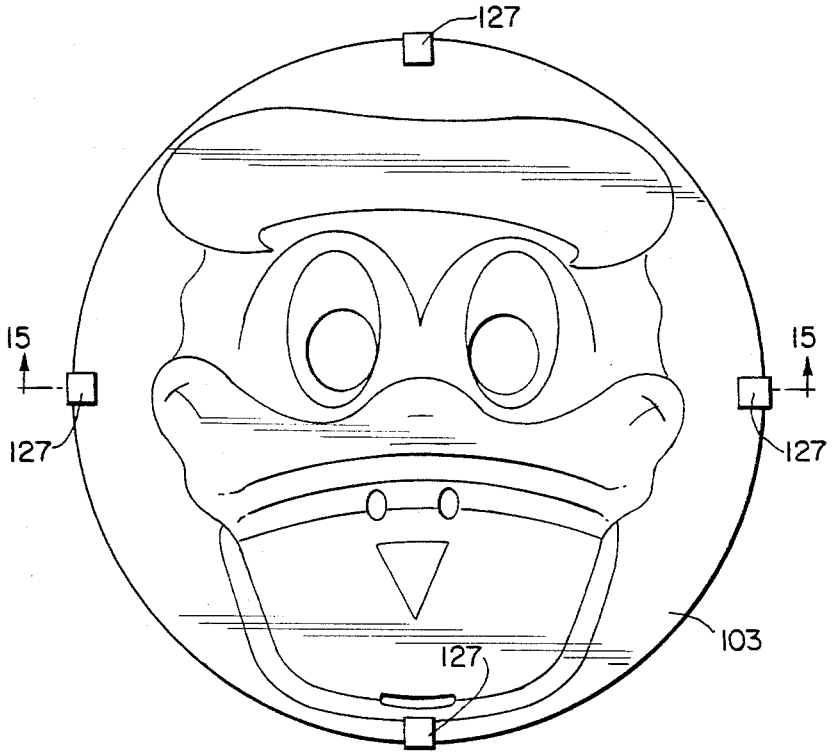
FIG. 14 is an elevational view taken as indicated by line 14—14, FIG. 10.
Figure 15:
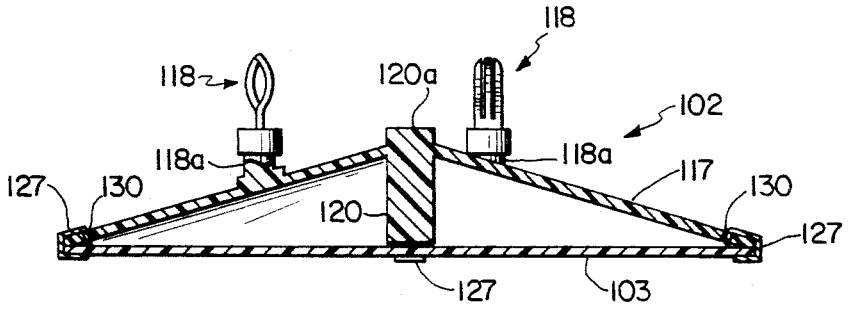
FIG. 15 is a sectional view taken generally on line 15—15, FIG. 14.

Shield 103 is in the form of a flat circular piece of rigid polymeric material, the diameter of the periphery of the shield being identical with that of the periphery of main wall 117 of the support so that the shield can be overlaid on the support, completely closing the bottom thereon, as will be apparent from FIGS. 10 and 14. As shown in FIGS. 10, 14 and 15, the shield is detachably secured to main wall 117 of the support by four clips 127 each in the form of a flat ductile metal strip having an upper end hooked through an opening 130 in wall 117, the strip extending downwardly from opening 130 over wall 117, being bent around the periphery and thence projecting for a short distance beneath the shield.

With the effective length of each stem 118*a* and prong 118 being considerably greater than the upwardly projecting portion of pin 120, suspension of the combination of support 102 and shield 103 from housing 101 is such that there is a significant distance between wall 117 of the support and bottom wall 107 of the housing shell, and a considerable free space is left for travel of air and smoke via openings 114. Further, the conical nature of wall 117 coacts with the housing to define a passage tending to promote air and smoke flow through openings 114, whether the flow be from the ceiling and downwardly through openings 114 or in the opposite direction, with the air and smoke entering the housing via openings 114 and escaping via the annular opening through base 108 and the upper edge of the housing shell.

Since the portions of prongs 118 below the bent fingers of the prongs are flat, and thinner than openings 114 are wide, an upward force applied by pushing on shield 103 will cause the combination of the shield and support to move upwardly, relative to the housing, until pin 120 engages and actuates push button 115.

Shield 103 is readily replaceable by bending and releasing clips 127, so that the shield can be in any flat image-bearing form. For illustrative purposes, the bottom face of the shield has been illustrated as bearing a flat image of the cartoon character Mickey Mouse, with the image so disposed on the circular shield that the nose of the image is approximately at the center of the shield. Thus, testing of the smoke detector can be accomplished by pushing against the nose of the image.

What is claimed is:

1. In a smoke detector, the combination of a smoke detector housing adapted to be mounted on the ceiling or wall of a room and having smoke flow openings exposed to the space within the room when the housing is so mounted;

a decorative masking shield having lateral dimensions at least as great as those of the housing; and a support to which the decorative shield is secured, the support including portions which are spaced from the shield and constructed and arranged to co-act with portions of the housing as releasable fastener means securing the combination of the support and decorative shield to the housing, the support being dimensioned and arranged to position the decorative shield a substantial distance from the smoke flow openings of the housing when said portions of the support are engaged with said portions of the housing, the dimensions and shape of the shield being such that, when so secured and positioned, the shield overlies only part of the housing to obscure the housing from normal view from within the room, and the dimensions and shapes of the fastener means, the support and the shield being such that the flow of air and smoke to and through the smoke detector housing openings is not substantially diminished by the support and the shield.

2. The combination defined by claim 8, wherein the support comprises a plurality of resiliently deformable mounting prongs; and the housing is provided with a plurality of openings each disposed and dimensioned to accept a different one of the mounting prongs, the edges defining the openings being disposed to coact with the respective prongs in releasable fastener fashion, the plan dimensions of the openings being significantly larger than the transverse cross section of the prongs, whereby a substantial part of the area of each opening is free to allow passage of smoke.

3. The combination defined by claim 1, wherein the shield is flat, and the face of the shield which is directed away from the housing when the support and decorative shield are secured to the housing bears a decorative design.

4. The combination defined by claim 3, wherein the decorative design is carried by a sheet member releasably secured to the face of the shield.

5. The combination defined by claim 1, wherein the decorative shield is releasably secured to the support.

6. The combination defined by claim 1, wherein the housing encloses test means comprising a switch-operating push button which is directed toward the decorative shield when the support and shield are secured to the housing; and the portions of the support and housing which coact as releasable fastener means provide a lost-motion connection allowing the shield to be pushed toward the housing when the support and shield are secured to the housing, one of said support and said decorative shield having an actuator disposed to engage and actuate the push button.

7. The combination defined by claim 1, wherein the housing has an annular series of laterally directed smoke flow openings; and the support comprises hook members engageable with the housing through said openings.

8. The combination defined by claim 1, wherein the support is an integral piece comprising an annular member lying in a flat plane and a plurality of resiliently deformable securing prongs projecting from one side of the annular member for engagement with said portions of the housing; and the decorative shield comprises a flat member and means for securing the flat member to the other side of the annular member opposite the prongs.

9. The combination defined by claim 8, wherein the means for securing the flat member of the shield to the annular member comprises a plurality of resiliently deformable clips projecting from one face of the flat member.

10. In combination, a decorative masking shield for use with a smoke detector, said smoke detector comprising a housing formed with openings to permit the flow of air and smoke through said smoke detector, said smoke detector comprising test means within said housing, said test means comprising a push button extending out of said housing, a support, means to removably mount said decorative masking shield on said support, said support comprising releasable lost motion fastener means to releasably mount said support with said decorative masking shield thereon on said smoke detector housing via said smoke flow openings, said fastener means comprising resilient prong means of a size in plan dimensions substantially smaller than said smoke detector openings so as to allow free passage of air and smoke through said smoke detector housing, said support and said decorative masking shield being of such dimensions as to overlie only parts of said housing and to substantially totally obscure said smoke detector housing from view in normal usage of said smoke detector with said decorative masking shield and said support thereon, said support and said releasable fastener means being of such dimensions and shape with respect to the dimensions and shape of said smoke detector that the flow of air and smoke through said smoke detector openings is not substantially diminished by the presence of said support with said decorative masking shield thereon, one of said support and said decorative masking shield comprising actuator means arranged to operate said push button when said decorative masking shield is moved towards said smoke detector, and said motion of said decorative masking shield towards and then away from said smoke detector being permitted and controlled by said releasable lost motion fastener means.

11. The combination of claim 10, wherein the shield is flat, and the face of the shield which is directed away from the housing when the support and decorative shield are secured to the housing bears a decorative design.

12. The combination of claim 11, wherein the decorative design is carried by a sheet member releasably secured to the face of the shield

13. The combination of claim 10, wherein the support is an integral piece comprising an angular member lying in a flat plane and a plurality of resiliently deformable securing prongs projecting from the annular member for engagement with said portions of the housing; and the decorative shield comprises a flat member and means for securing the flat member to the side of the annular member opposite the prongs.

14. The combination of claim 13, wherein the means for securing the flat member of the shield to the annular member comprises a plurality of resiliently deformable clips projecting from one face of the flat member.

15. The combination of claim 10, said support being of a generally conical configuration flaring outwardly away from said smoke detector when moving radially outwardly of the center of said support, and said conical configuration acting to enhance the flow of air and smoke through said smoke detector housing.

16. A decorative masking shield for use with a smoke detector, a support for said decorative masking shield and means to removably mount said decorative masking shield on said support, said smoke detector being of the type comprising a housing formed with air and smoke flow openings and including a test push button, said support comprising releasable lost motion fastener means to releasably mount said support with said decorative masking shield thereon on said smoke detector housing via said smoke flow openings, said fastener means comprising resilient prong means of a size in plan dimensions substantially smaller than said smoke detector openings so as to allow free passage of air and smoke through said smoke detector housing, said support and said decorative masking shield being of such dimensions as to overlie only parts of said housing and to substantially totally obscure said smoke detector housing from view in normal usage of said smoke detector with said decorative masking shield and said support thereon, said support and said releasable fastener means being of such dimensions and shape with respect to the dimensions and shape of said smoke detector that the flow of air and smoke through said smoke detector openings is not substantially diminished by the presence of said support with said decorative masking shield thereon, one of said support and said decorative masking shield comprising actuator means arranged to operate said push button when said decorative masking shield is moved towards said smoke detector, and said motion of said decorative masking shield towards and then away from said smoke detector being permitted and controlled by said releasable lost motion fastener means.

* * * * *

UNITED STATES PATENT AND TRADEMARK OFFICE

CERTIFICATE OF CORRECTION

PATENT NO. 4,529,976

DATED July 16, 1985

INVENTOR(S) : FREDERICK M. JAMESON and DONALD C. ROYLANCE

It is certified that error appears in the above—identified patent and that said Letters Patent is hereby corrected as shown below:

Claim 2, line 1, cancel "8" and substitute --1--

Signed and Sealed this

*First* Day of *October 1985*

[SEAL]

*Attest:*

DONALD J. QUIGG

*Attesting Officer*

*Commissioner of Patents and Trademarks—Designate*